United States Patent [19]

Klundt

[11] 4,145,985

[45] Mar. 27, 1979

[54] SEWING MACHINE HAVING A COOLING AIR BLOWER

[75] Inventor: Kurt Klundt, Hirschhorn, Fed. Rep. of Germany

[73] Assignee: Pfaff Industriemaschinen GmbH, Fed. Rep. of Germany

[21] Appl. No.: 868,751

[22] Filed: Jan. 12, 1978

[30] Foreign Application Priority Data

Feb. 3, 1977 [DE] Fed. Rep. of Germany ... 7703092[U]

[51] Int. Cl.[2] ..... D05B 71/00

[52] U.S. Cl. ..... 112/280

[58] Field of Search ..... 112/218 R, 280; 416/60; 415/219 B

[56] References Cited

U.S. PATENT DOCUMENTS

| | | | |
|---|---|---|---|
| 3,638,594 | 2/1972 | Armstead et al. | 112/280 |
| 3,771,478 | 11/1973 | Tranquilla et al. | 112/280 |
| 3,779,188 | 12/1973 | Marforio | 112/280 |
| 4,062,310 | 12/1977 | Gauch et al. | 112/280 |

*Primary Examiner*—Henry Jaudon

*Attorney, Agent, or Firm*—McGlew and Tuttle

[57] ABSTRACT

A sewing machine having a rotatable main shaft connected to a needle to reciprocate it includes an impeller or air fan which has a hub portion which is connectable to the main shaft of the sewing machine for rotation thereby. The impeller housing also includes a plurality of radially extending fans defining air flow passages therebetween and a central axially extending tubular inlet forming the inlet for inward axial flow and then radial outward flow and peripheral discharge for circulation of the air through a cooling chamber defined in the sewing machine below the oil pan housing part. The impeller also includes an exterior groove around the tubular part which defines a pulley for a V-belt so that the impeller may function as a drive for the shaft. In addition, a hand wheel is secured around the periphery of the tubular part to facilitate hand rotation of the shaft. The hand wheel advantageously includes an opening aligned with the opening of the impeller for the inflow of air therethrough.

8 Claims, 2 Drawing Figures

SEWING MACHINE HAVING A COOLING AIR BLOWER

FIELD AND BACKGROUND OF THE INVENTION

This invention relates to sewing machines in general and, in particular, to a new and useful sewing machine with a hand wheel and a cooling air blower which has a radial flow impeller fastened to the main shaft and with an air intake opening provided at one face thereof.

DESCRIPTION OF THE PRIOR ART

In high speed sewing machines, it is known to cool the oil in the oil pan by a flow of air produced by a blower and conducted between several heat dissipation ribs disposed on the underside of the oil pan.

In a sewing machine known from German Offenlegungschrifft 2,331,966, the blower consists of an axial flow impeller fastened to the main shaft, a blower chamber adjacent in an axial direction, and several guide vanes disposed in the blower chamber which deflect the air flow produced by the impeller downwardly to conduct it to the air channels formed by the ribs. The air flow produced by the impeller is of a relatively large cross-sectional area, in essence, corresponding to the impeller diameter. If this air flow is intended to be conducted to all of the air channels at the same time, as in the known sewing machine, it is deflected in its entire width by the guide vanes. However, if only a part of the air flow is to be fed to the air channels, the air flow, which is too wide in this case, must first be bunched by guiding means narrowing down like a funnel. Due to the increased flow resistance which then occurs, the efficiency of the blower becomes poorer. Moreover, such funnel-shaped guiding means, disposed behind the blower chamber in the flow direction, requires additional space within the sewing machine housing.

A sewing machine is also known from German Offenlegungschrifft No. 2,229,034, and it includes a blower with a radial flow impeller and a blower chamber expanding helically with radial clearance from the outside diameter of the impeller. Due to this blower chamber design, the blower is more compact in an axial direction compared to an axial blower and a bunched air flow is achieved in a relatively simple and flow-technically advantageous manner, provided that the discharge opening of the blower chamber is appropriately designed. However, since the impeller air intake openings are spaced radially from the main shaft, the resultant impeller diameter is relative large and, hence, the blower requires much space in a radial direction.

SUMMARY OF THE INVENTION

The present invention provides a sewing machine with a highly efficient cooling air blower which requires little space in both the axial and radial directions.

The solution of this problem is characterized in that the impeller is disposed at the end of the main shaft, that its air intake opening is centrally located, and in that a hand wheel is seated on the impeller and is provided with a bore which is aligned with the impeller air intake opening.

Compared with an impeller having an annular air intake opening radially spaced from the rotating shaft, the impeller according to the invention makes it possible, by placing the air intake opening into the radial center of the impeller, to reduce the spacing of the impeller blades from the rotating shaft. What this accomplishes in the impeller, according to the invention, is an outside diameter which is smaller than that of an impeller with an annular air intake opening radially spaced from the rotating shaft. Since, in addition, the air flows radially through the impeller, according to the invention, and the blower chamber is accordingly coordinated with the circumferential area of the impeller, little space is also required in an axial direction.

By moving the air intake opening of the impeller into the impeller's center and by locating the air passage bore centrally in the hand wheel, unobstructed, and thus, flow-technically advantageous air entry into the impeller is achieved, enabling the cooling air blower to pump a relatively large volume of air per unit of time.

The arrangement of the air intake bore in the hand wheel brings with it the additional advantage of a simpler machine housing design since separate air intake openings in it can be omitted.

According to a further advanced suggestion of the invention, for a sewing machine with a pulley mounted on the main shaft, the pulley is disposed between the impeller and the hand wheel and it is provided with a bore aligned with the hand wheel bore. Since, in this arrangement, the impeller supports the pulley and the pulley supports the hand wheel, these components are closer together in an axial direction than when mounted separately on the main shaft. Therefore, this suggestion of the invention achieves a space-saving sewing machine design.

A cooling air blower design which is particularly advantageous from a production point of view is characterized, according to another suggestion of the invention, in that at least the impeller and the pulley are combined into one component part which is producible, for example, by die casting.

Accordingly, it is an object of the invention to provide in a sewing machine which has a rotatable main shaft connected to a needle to reciprocate the needle, an improved impeller, which has a housing with a hub portion adapted to be connected to the main shaft for rotation therewith and at least one radially extending pump passage portion with a tubular central inlet portion for the inflow of air axially and then radially for a peripheral discharge thereof, said central inlet portion terminating in an inlet opening and having an exterior with a pulley belt receiving groove defined therearound and further including a hand wheel portion defined on the exterior of the tubular central portion of the impeller.

A further object of the invention is to provide a sewing machine having a cooling air blower, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENT

Figure 1:
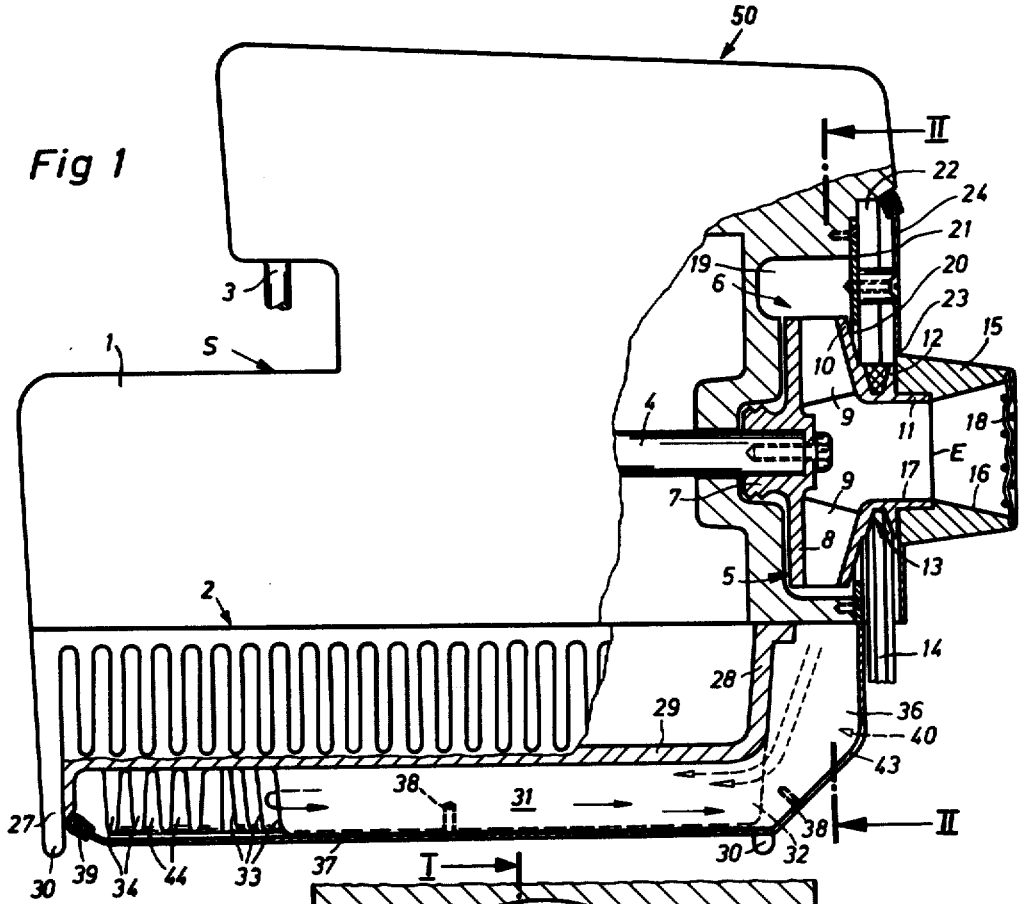
FIG. 1 is a partial elevational and partial sectional view of a sewing machine having an improved impeller constructed in accordance with the invention.

Referring to the drawing in particular, the invention embodied therein, comprises an improved air fan or impeller which also functions as a pulley and a hand wheel, generally designated 5, and is fixed to a main shaft 4 which is rotatably mounted in a sewing machine, generally designated 50. Sewing machine 50 has a housing 1 and an oil pan 2. A needle bar 3, shown only partly in FIG. 1, marks the position of the sewing machine's stitch-forming point S.

A main shaft 4 is mounted in housing 1, at the end of which, an impeller 5 of a cooling air blower 6 is fastened. The impeller 5 includes a hub 7 forming shaft connection means, a through plate 8 connected thereto and several blades 9 which support a ring 10. Further, an annular or tubular axial extension 11, also having an annular shoulder 12, is disposed on the ring 10. The inner part of ring 10, extension 11 and the shoulder 12 form a pulley 13 for a V-belt 14 to drive the main shaft 4. A hand wheel 15 is attached to the outer end of the annular extension 11. The impeller 5 and the pulley 13 of the embodiment described are combined into one component part which is producible, for example, by die casting.

In order that air can enter the impeller 5 axially without obstruction, the hand wheel 15 has a bore 16 tapering down in a funnel-shape, and impeller 5 and pulley 13, respectively, have an essentially cylindrical bore 17. The intake opening of bore 17 also forms the air intake opening E of the impeller. The intake opening of bore 16 is covered by a screen 18. The impeller 5 is located inside of a helical blower chamber 19 formed in housing 1 and closed towards the outside by a cover plate 21 which is provided with a cutout 20. The V-belt 14 runs in a cutout 22 in housing 1 and is covered by a belt cover plate 24 having a cutout 23.

The oil pan 2 comprises longitudinal sidewalls 25 and 26 running parallel to the main shaft 4, transverse end walls 27 and 28 and a bottom 29. The long sidewalls 25 and 26 and the short end wall 27, located in the area of the sewing machine end facing the stitch-forming point S, are drawn down far below the bottom 29. Feet 30 are formed at the lower ends of the sidewalls 25 and 26.

Longitudinal ribs are arranged parallel to the main shaft 4 on the underside of the bottom 29 of oil pan 2, of which the one in the middle is marked 31, while the others have the reference character 32. Starting at the end of oil pan 2 facing the hand wheel 15, the longitudinal ribs 31 and 32 cover about three-fourths of the length of oil pan 2. The ends of the longitudinal ribs 31 and 32 facing the stitch-forming point S are marked with the reference character 33. The cooling air deflection means are formed by the arched ribs 34 directly adjoining the ends 33 of the central and outer longitudinal ribs 32, connecting two longitudinal ribs 32 each of the same spacing from the central longitudinal rib 31. The arched ribs 34 are interrupted by several recesses. At its end facing the hand wheel 15, the central longitudinal rib 31 continues as a web 36 connected to the short sidewall 28 and extending to the underside of housing 1.

The longitudinal ribs 31 and 32 and the arched ribs 34 are covered by a cover plate 37 bent up at the end of oil pan 2 facing the hand wheel 15 and extending, in contact with web 36, to the underside of housing 1. The cover plate 37 is fastened to the central longitudinal rib 31 and to the web 36 by means of two screws 38, and its edges support U-shaped sealing strips 39.

Figure 2:
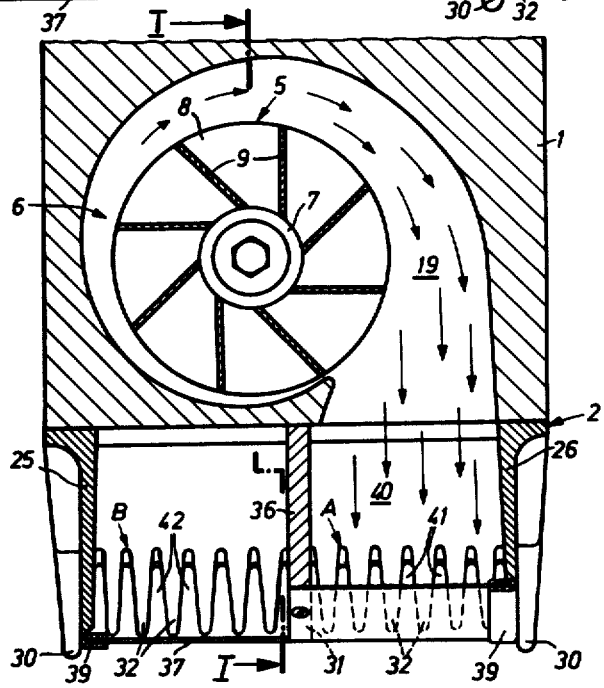
FIG. 2 is a section taken along the line II—II of FIG. 1.

Together, the long sidewall 26, the short end wall 28, the web 36 and the cover plate 37, form an air chute 40 into which the helical blower chamber 19 empties. The cover plate 37, together with the central longitudinal rib 31, the longitudinal ribs 32 disposed to its right in FIG. 2, and the long sidewall 26, form a group A or air channels 41 connected to the air chute 40. Furthermore, the cover plate 37, together with the central longitudinal rib 31, the longitudinal ribs 32 disposed to its left in FIG. 2, and the long sidewall 25, form a group B of air channels 42, whose ends facing the hand wheel 15 are opposite a cutout 43 in the bent-up portion of cover plate 37, said cutout essentially corresponding to the overall width and height of these air channels 42. In addition, the cover plate 37, together with the arched ribs 34, form arch-shaped channels 44 interconnecting the air channels 41 and 42.

When the sewing machine is in operation, the impeller 5 automatically rotating with the main shaft 4 sucks air from the surroundings of hand wheel 15 through the bore 16, the intake opening E and the bore 17, and pumps it into the blower chamber 19. The cooling air flows from there into the air chute 40 and then into the air channels 41 in which it flows in the direction of the stitch-forming point S. The various cooling air flows are deflected by 180° in the arch-shaped air channels 44 formed by the arch ribs 34 which serve as deflection means and conducted into the air channels 42 in which they then flow in the direction of the hand wheel 15. After leaving the air channels 42, the cooling air discharges into the open through the cutout 43 in the cover plate 37.

While a specific embodiment of the invention has been shown and described in detail to illustrate the application of the principles of the invention, it will be understood that the invention may be embodied otherwise without departing from such principles.

What is claimed is:

1. In a sewing machine having a rotatable main shaft connected to a needle to reciprocate the needle, the improvement comprising, an impeller housing having a hub portion adapted to be connected to the main shaft for rotation therewith, at least one radially extending air passage pump portion, a tubular central portion connected to said radially extending pump passage portion and having a central inlet extending axially away from said hub portion and terminating in an inlet opening, a pulley belt receiving groove defined around said tubular central portion, and a hand wheel portion defined on the exterior of said tubular central portion.

2. In a sewing machine, the improvement claimed in claim 1, wherein said hand wheel has a central opening defining a continuation of the inlet of said impeller.

3. In a sewing machine, the improvement claimed in claim 1, wherein said impeller includes a bore defined on said hub portion for receiving the main shaft therein on the end opposite to the inlet opening, said hand wheel having a portion extending beyond the inlet opening, a bore therethrough in communication with said inlet opening for the inflow of air therethrough and having a screen at the outer end thereof.

4. In a sewing machine, the improvement claimed in claim 1, wherein at least said impeller and said pulley are formed as a single part.

5. A combined hand wheel and fan, particularly for a sewing machine, including an impeller housing having a hub portion with a receiving bore opening toward one end thereof, the opposite end of said impeller having a tubular part forming an inlet opening, said impeller having at least one radial passage for the flow of air from the inlet opening radially outwardly and a hand wheel mounted on said tubular portion.

6. A combined hand wheel and fan, as claimed in claim 5, including a belt pulley defined around the exterior of said tubular portion.

7. A combined hand wheel and fan, as claimed in claim 5, including a pulley integrally formed with said impeller having a groove disposed around said tubular central portion, a hand wheel having a portion engaged on said tubular central portion exteriorly of said pulley and having a portion extending beyond the end of said tubular central portion with an opening therethrough aligned with the air inlet of said tubular portion.

8. In a sewing machine having a rotatable main shaft connected to a needle to reciprocate it, the improvement comprising, an impeller housing having a hub portion adapted to be connected to the main shaft for rotation therewith, at least one radially extending pump passage portion and a tubular central inlet portion connecting said pump passage at the center thereof and extending axially away from said hub portion and terminating in an axially disposed inlet opening, and a hand wheel portion extending around said tubular central inlet portion.

* * * * *